US009726198B2

(12) United States Patent
Friedrich

(10) Patent No.: US 9,726,198 B2
(45) Date of Patent: Aug. 8, 2017

(54) COMPRESSOR OF AN EXHAUST-GAS TURBOCHARGER

(75) Inventor: Peter Friedrich, Lampertheim (DE)

(73) Assignee: BorgWarner Inc., Auburn Hills, MI (US)

( * ) Notice: Subject to any disclaimer, the term of this patent is extended or adjusted under 35 U.S.C. 154(b) by 531 days.

(21) Appl. No.: 13/320,284

(22) PCT Filed: May 7, 2010

(86) PCT No.: PCT/US2010/033961

§ 371 (c)(1),
(2), (4) Date: Nov. 14, 2011

(87) PCT Pub. No.: WO2010/135091

PCT Pub. Date: Nov. 25, 2010

(65) Prior Publication Data

US 2012/0057963 A1 Mar. 8, 2012

(30) Foreign Application Priority Data

May 18, 2009 (DE) ..... 10 2009 021 745

(51) Int. Cl.

| | |
|---|---|
| ***F04D 29/66*** | (2006.01) |
| ***F04D 29/70*** | (2006.01) |
| ***F04D 29/42*** | (2006.01) |

(52) U.S. Cl.

CPC ..... *F04D 29/70* (2013.01); *F04D 29/422* (2013.01); *F04D 29/665* (2013.01); *F05B 2220/40* (2013.01)

(58) Field of Classification Search

CPC ..... F04D 29/422; F04D 29/665; F04D 29/70; F05B 2220/40

USPC ..... 415/119, 212.1, 232; 181/250

See application file for complete search history.

(56) References Cited

U.S. PATENT DOCUMENTS

| | | | | |
|---|---|---|---|---|
| 3,929,357 | A * | 12/1975 | DeVincent et al. | 285/319 |
| 4,575,133 | A * | 3/1986 | Nattel | 285/319 |
| 4,969,536 | A * | 11/1990 | Allen | 181/229 |
| 5,302,783 | A * | 4/1994 | Sadr et al. | 181/243 |
| 6,508,331 | B1 * | 1/2003 | Stuart | F02M 35/125 123/184.57 |
| 7,584,821 | B2 * | 9/2009 | Prior et al. | 181/241 |
| 8,177,024 | B2 * | 5/2012 | Caliskan | F02M 35/10321 123/184.53 |
| 8,323,556 | B2 * | 12/2012 | Khami | F02B 33/44 264/510 |
| 2003/0085071 | A1 * | 5/2003 | Boast et al. | 181/249 |
| 2005/0150718 | A1 * | 7/2005 | Knight et al. | 181/250 |
| 2008/0292449 | A1 * | 11/2008 | Lefevre | F04D 29/665 415/58.4 |

* cited by examiner

*Primary Examiner* — Craig Kim
*Assistant Examiner* — Alexander White
(74) *Attorney, Agent, or Firm* — Eric L. Doyle; Stephan A. Pendorf; Patent Central LLC

(57) ABSTRACT

The present invention relates to a compressor (1) of an exhaust-gas turbocharger having a compressor housing (2) which has a compressor outlet connecting pipe (3), and having a sound absorber (4), wherein the sound absorber (4) is formed as a separate component which can be connected to the outlet connecting pipe (3).

5 Claims, 3 Drawing Sheets

COMPRESSOR OF AN EXHAUST-GAS TURBOCHARGER

BACKGROUND OF THE INVENTION

Field of the Invention

The invention relates to a compressor of an exhaust-gas turbocharger.

A generic compressor is known from WO 2005/124159 A1.

Description of the Related Art

Here, the compressor has a sound absorber element which is integrated in the compressor housing and which performs the sound absorbing function in the interior of the compressor. Said design has the disadvantage not only of being complex and expensive but rather also of not permitting sound-related adjustment without it being necessary to make changes to the compressor housing.

BRIEF SUMMARY OF THE INVENTION

It is therefore an object of the present invention to provide a compressor for a turbocharger of an internal combustion engine which overcomes the disadvantages mentioned above.

The compressor according to the invention has the advantage that it has a sound absorber which is formed as a separate component which is connected to an outlet connecting pipe of the compressor by means of assembly without screws. As a result of the use of lightweight materials for the sound absorber which is arranged outside the compressor housing, in relation to the abovementioned compressor of the prior art, not only is a weight reduction of the entire compressor assembly obtained but simplified adaptation to sound-related requirements without modification of the compressor housing is also enabled.

The subclaims relate to advantageous refinements of the invention.

BRIEF DESCRIPTION OF THE SEVERAL VIEWS OF THE DRAWINGS

Further details, features and advantages of the invention will emerge from the following description of an exemplary embodiment and from the drawing, in which.

DETAILED DESCRIPTION OF THE INVENTION

Figure 1:
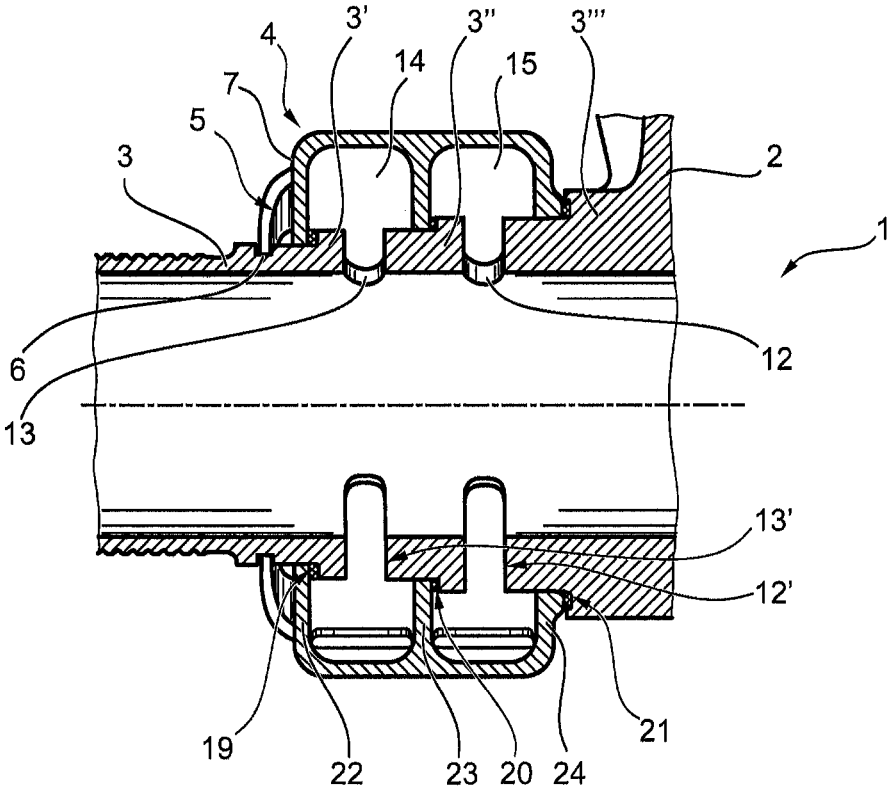
FIG. 1 shows a sectional view through a first embodiment of a sound absorber of the compressor according to the invention.

A first embodiment of a compressor 1 according to the invention will be described in detail below on the basis of a juxtaposition of FIG. 1 and FIG. 2. As can be seen from FIG. 1, the compressor 1, of which only an outlet connecting pipe 3 can be seen here, has an annular sound absorber 4 which is arranged, as a separate component, on the outer side of the outlet connecting pipe 3.

Two chambers 14, 15 which are divided by radial walls 22, 23 and 24 are formed in the interior of the sound absorber 4, which chambers 14, 15 are connected to the interior of the outlet connecting pipe 3 via two radial connecting ducts 12, 13 and two connecting ducts 12', 13' arranged opposite the connecting ducts 12, 13, and which chambers 14, 15 serve to generate sound absorption of the gas flow flowing out of the compressor housing (not illustrated).

Figure 2:
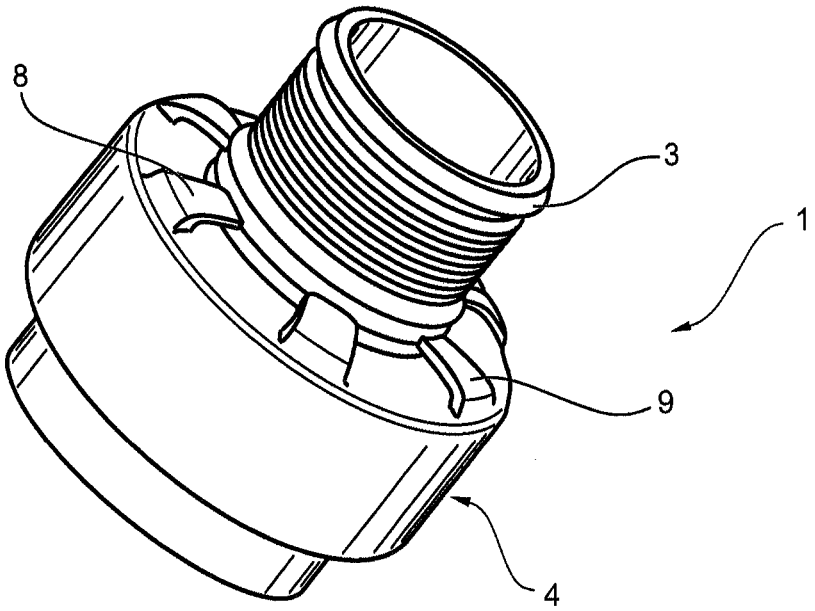
FIG. 2 shows a perspective view of the sound absorber of the compressor from FIG. 1.

A holding device 5 which is arranged on an end side 7, which points away from the compressor 1, of the sound absorber 4 has a multiplicity of clips, two of which clips are denoted, as representatives of all of the clips, by the reference numerals 8 and 9 in FIG. 2.

To fasten the sound absorber 4 to the outlet connecting pipe 3 of the compressor 1, after the walls 22, 23, 24 of the two chambers 14, 15 of the sound absorber 4 have been pushed against three shoulders 3', 3", 3'" which are formed on the outer circumference of the outlet connecting pipe 3, the clips 8, 9 are clipped into an encircling holding groove 6 which is formed in the outlet connecting pipe 3. In each case one seal 19, 20 and 21 is arranged between the shoulders 3', 3", 3'" of the outlet connecting pipe 3 and the walls 22, 23, 24, in order to seal off the sound absorber 4 with respect to the outside and to separate the two chambers 14 and 15.

Figure 3:
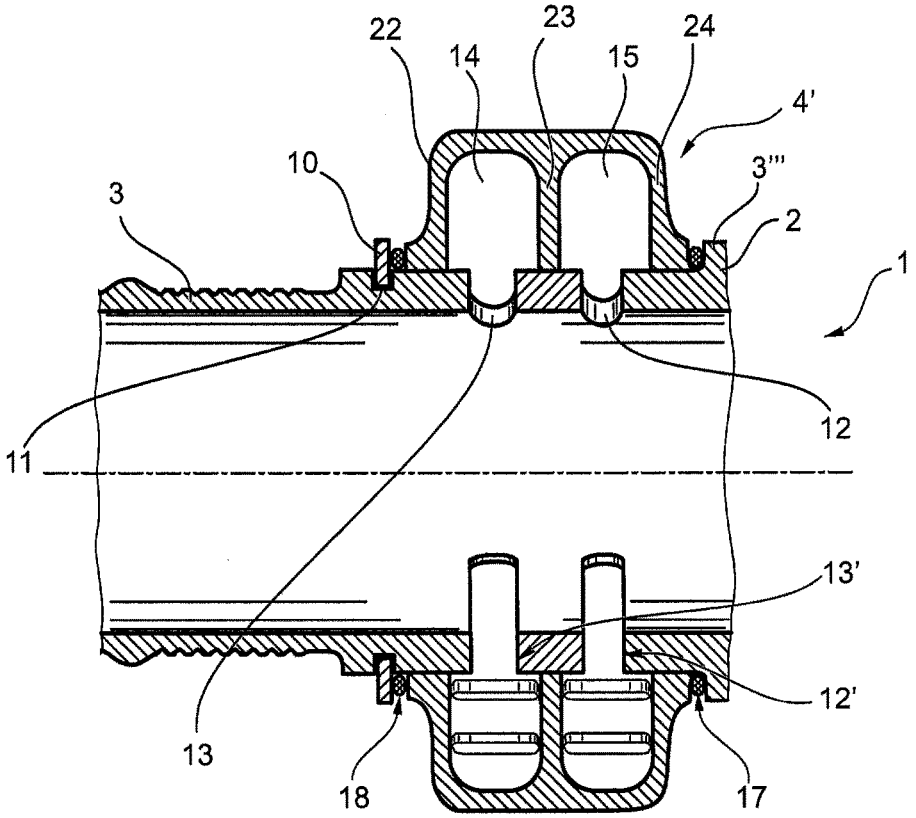
FIG. 3 shows an illustration, corresponding to FIG. 1, of a second embodiment of the sound absorber of the compressor.
Figure 4:
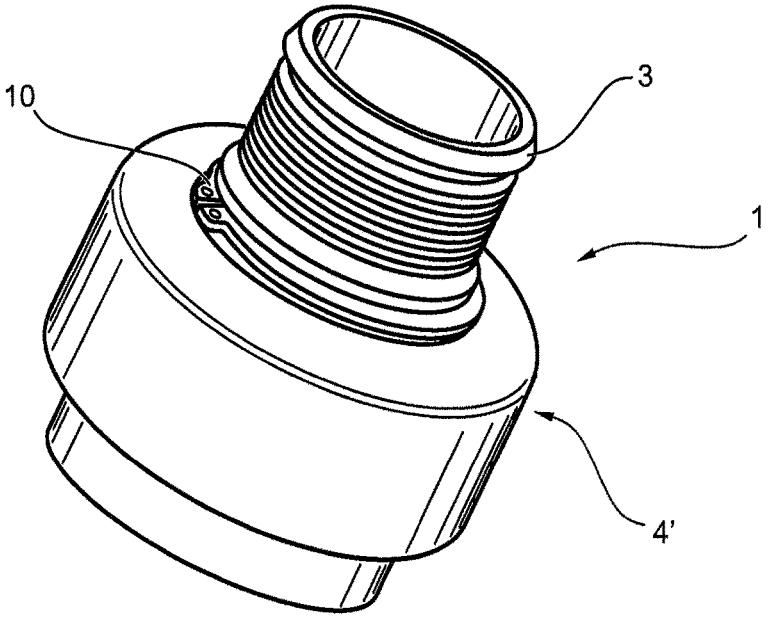
FIG. 4 shows an illustration, corresponding to FIG. 2, of the second embodiment of the sound absorber of the compressor.

FIG. 3 illustrates a further embodiment of a sound absorber 4' of the compressor 1 according to the invention. Here, identical components are denoted by the same reference symbols as in the first embodiment of FIG. 1. As can be seen from FIG. 3, the outlet connecting pipe 3 of the compressor 1 in this embodiment has, in contrast to the first embodiment, only one shoulder 3'" and no holding device 5 formed on the sound absorber 4', as in the first embodiment of FIG. 1. In this embodiment, to fasten the sound absorber 4' on the outlet connecting pipe 3 of the compressor 1, the sound absorber 4' is pushed against the shoulder 3'" of the outlet connecting pipe 3 and is fastened by means of a holding element 10 which is preferably designed as a circlip and engages into a holding groove 11 of the outlet connecting pipe 3. A seal 17 is arranged between the shoulder 3'" of the outlet connecting pipe 3 and the wall 24 of the sound absorber 4, and a seal 18 is arranged between the wall 22 and the circlip 10, in order to seal off the sound absorber 4' to the outside.

Figure 5:
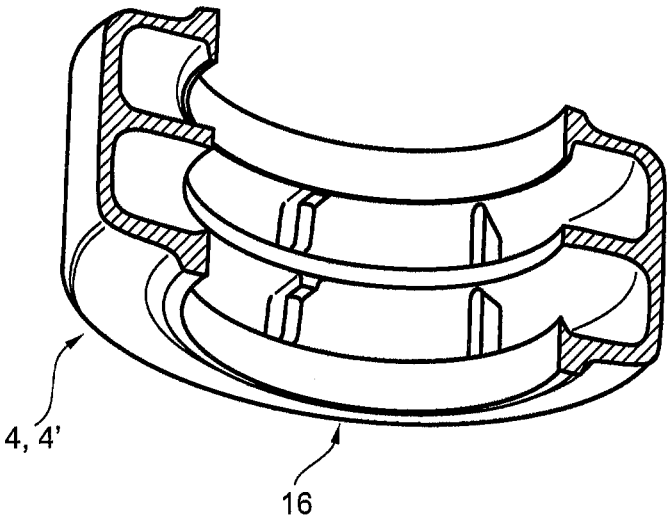
FIG. 5 shows a partially cut-away perspective view of a half-shell of the sound absorber of the compressor according to the invention.

The above-described embodiments of the sound absorber 4 and 4' are constructed from two annular shell components or half shells 16, 16' which can be connected to one another, with the perspective, partially cut-away view of FIG. 5 illustrating only the half shell 16, which is preferably formed as a plastic injection-molded part, of the sound absorber 4, 4', and the chambers 14, 15 arranged therein. The two annular half shells 16, 16' may be differently-shaped components or, for adaptation to an available installation space of the compressor housing 2, may if necessary have a geometric shape differing from a circular cross section. To simplify assembly, the two half shells 16, 16' are connected to one another preferably by means of plastic welding, adhesive bonding or by means of clips. It is alternatively also conceivable for a complete sound absorber housing to have more than two components.

To complement the disclosure, reference is explicitly made to the diagrammatic illustration of the invention in FIGS. 1 to 5.

LIST OF REFERENCE SYMBOLS

1 Compressor
2 Compressor housing
3 Outlet connecting pipe
3', 3", 3'" Shoulder on outlet connecting pipe
4 Sound absorber
5 Holding device of the sound absorber
6 Holding groove in the outlet connecting pipe
7 End side pointing away from the compressor housing
8, 9 Clips
10 Holding element, circlip
11 Holding groove in the outlet connecting pipe
12, 13 Connecting duct
12', 13' Connecting duct
14, 15 Chambers
16, 16' Shell component, half shell
17, 18 Seals
19, 20, 21 Seals
22, 23, 24 Radial walls of the sound absorber

The invention claimed is:

1. A compressor (1) of an exhaust-gas turbocharger with a clip-on easily exchangeable sound absorber for sound related adjustment, comprising:

a compressor housing (2) which has a compressor outlet connecting pipe (3), and a sound absorber (4) in the form of a shell having exterior walls (22, 24) arranged around the outside of the compressor outlet connecting pipe, the sound absorber having in its interior two axially spaced chambers (14, 15) which are separated from each other by at least one internal radial wall (23), wherein the outlet connecting pipe (3) has two circumferentially elongate radial connecting ducts (12, 13) in communication with the two chambers of the sound absorber, the sound absorber (4) is formed as a separate component releasably connected to the outlet connecting pipe (3) and adapted to the sound-related requirements of the compressor (1), and the sound absorber (4) is clipped onto the outlet connecting pipe (3) by means of:

(i) a separate holding element (10) after the sound absorber (4) is pushed on the outlet connecting pipe (3) or (ii)

(ii) a multiplicity of clips (8, 9) provided on the end side (7) of the sound absorber (4) pointing away from the compressor housing (2) and which, in an assembled state, engage into a holding groove (6) of the outlet connecting pipe (3).

2. The compressor as claimed in claim 1, wherein the sound absorber (4) is constructed from shell components (16, 16') adapted to be connected to one another.

3. The compressor as claimed in claim 2, wherein the shell components (16, 16') are half shells.

4. The compressor as claimed in claim 3, wherein the shell components (16, 16') are differently-shaped components.

5. The compressor as claimed in claim 1, wherein the outlet connecting pipe (3) is further in communication with the first and second axially spaced chambers (14, 15) via two additional circumferentially elongate radial connecting ducts (12', 13').

* * * * *